US010505302B2

(12) United States Patent
Watanabe et al.

(10) Patent No.: US 10,505,302 B2
(45) Date of Patent: Dec. 10, 2019

(54) CONNECTOR

(71) Applicant: Tyco Electronics Japan G.K., Kanagawa (JP)

(72) Inventors: Tatsuki Watanabe, Kanagawa (JP); Katsuhiko Kobayashi, Kanagawa (JP)

(73) Assignee: Tyco Electronics Japan G.K., Kanagawa (JP)

( * ) Notice: Subject to any disclaimer, the term of this patent is extended or adjusted under 35 U.S.C. 154(b) by 0 days.

(21) Appl. No.: 16/202,289

(22) Filed: Nov. 28, 2018

(65) Prior Publication Data

US 2019/0165506 A1 May 30, 2019

(30) Foreign Application Priority Data

Nov. 28, 2017 (JP) ..... 2017-227691

(51) Int. Cl.
*H01R 12/73* (2011.01)
*H01R 12/70* (2011.01)
*H01R 12/72* (2011.01)

(52) U.S. Cl.
CPC ..... *H01R 12/737* (2013.01); *H01R 12/7023* (2013.01); *H01R 12/721* (2013.01); *H01R 12/732* (2013.01)

(58) Field of Classification Search
CPC ..... H01R 12/737
See application file for complete search history.

(56) References Cited

U.S. PATENT DOCUMENTS 4,647,123 A * 3/1987 Chin ..... G06F 12/0676 361/785
5,800,186 A * 9/1998 Ramirez ..... H01R 12/721 439/74
6,171,115 B1 * 1/2001 Mickievicz ..... H01R 13/64 439/701
6,341,966 B1 * 1/2002 Takada ..... H01R 12/52 439/108
6,375,508 B1 * 4/2002 Pickles ..... H01R 12/727 439/607.11
6,540,522 B2 4/2003 Sipe
(Continued)

FOREIGN PATENT DOCUMENTS

JP 6-325829 A 11/1994
JP 2002-198131 A 7/2002
(Continued)

*Primary Examiner* — Ross N Gushi
(74) *Attorney, Agent, or Firm* — Barley Snyder

(57) ABSTRACT

A connector comprises a daughterboard and a metallic shell. The daughterboard has a first edge with first connection pads and a second edge with second connection pads. The first edge is inserted into an on-board connector including first contacts. The on-board connector is mounted on a mother-board and each of the first connection pads is connected to one of the first contacts. The metallic shell has side plates each facing and extending along one of a front board face and a back board face of the daughterboard. Each of the side plates has a base spaced apart from the front board face or the back board face and a retaining portion protruding inward from the base. The retaining portion retains the front board face or a back board face of the daughterboard and has an opening formed around the retaining portion extending through the metallic shell.

9 Claims, 9 Drawing Sheets

(56) References Cited

U.S. PATENT DOCUMENTS 6,551,117 B2 * 4/2003 Poplawski ..... C07D 491/22 361/752
6,623,310 B1 * 9/2003 Billman ..... H01R 13/514 439/701
6,638,110 B1 * 10/2003 Billman ..... H01R 13/514 439/108
6,655,966 B2 * 12/2003 Rothermel ..... H01R 13/6471 439/76.1
6,666,692 B2 * 12/2003 Billman ..... H01R 13/514 439/76.1
6,695,622 B2 * 2/2004 Korsunsky ..... H01R 31/06 439/631
6,712,646 B2 3/2004 Shindo
6,808,419 B1 * 10/2004 Korsunsky ..... H01R 13/6585 439/607.23
6,811,414 B1 * 11/2004 Consoli ..... H01R 12/716 439/65
6,817,868 B2 * 11/2004 Matsuo ..... H01R 12/52 439/65
6,866,549 B2 3/2005 Kimura et al.
6,884,117 B2 * 4/2005 Korsunsky ..... H01R 13/6585 439/607.11
6,918,774 B2 * 7/2005 Wu ..... H01R 31/06 439/65
6,932,649 B1 * 8/2005 Rothermel ..... H01R 13/6658 439/620.01
6,960,096 B2 * 11/2005 Takada ..... H01R 12/7005 439/327
7,044,748 B2 * 5/2006 Korsunsky ..... H05K 1/14 439/631
7,044,793 B2 5/2006 Takemasa
7,338,291 B2 * 3/2008 Takada ..... H01R 13/6315 439/65
7,425,137 B1 * 9/2008 Sipe ..... H01R 13/514 439/65
7,445,467 B1 * 11/2008 Matsuo ..... H01R 13/514 439/637
7,491,089 B2 * 2/2009 Lang ..... H01R 12/7005 439/358
7,604,483 B2 * 10/2009 Takada ..... H01R 12/716 439/591
7,780,474 B2 * 8/2010 Ito ..... H01R 23/6873 439/607.05
7,985,079 B1 * 7/2011 Wilson ..... H01R 12/52 439/74
7,997,909 B2 * 8/2011 Xu ..... H01R 13/6594 439/607.57
8,092,233 B1 * 1/2012 Lee ..... H01R 13/112 439/631
8,105,114 B2 * 1/2012 Kagotani ..... H01R 12/716 439/639
8,425,236 B2 * 4/2013 Cipolla ..... H01R 12/716 439/59
8,425,257 B2 * 4/2013 Gao ..... H01R 12/721 439/630
8,485,831 B2 * 7/2013 Cipolla ..... H01R 13/6587 439/607.07
8,585,427 B2 11/2013 Ukawa et al.
8,696,388 B2 * 4/2014 Gao ..... H01R 12/721 439/630
8,721,350 B2 * 5/2014 Liu ..... H01R 13/6315 439/65
8,979,562 B2 * 3/2015 Crighton ..... H01R 24/20 438/66
9,184,523 B2 * 11/2015 Tamai ..... H01R 31/06
9,356,370 B2 * 5/2016 Lee ..... H01R 12/71
9,478,889 B2 * 10/2016 Oshida ..... H01R 13/42
9,570,847 B2 * 2/2017 Hung ..... H01R 13/6275
9,685,718 B1 * 6/2017 Wang ..... H01R 12/52
9,705,258 B2 * 7/2017 Phillips ..... H01R 13/6581
9,865,948 B2 * 1/2018 Phillips ..... H01R 12/721
9,966,677 B2 * 5/2018 Tziviskos ..... H01R 12/72
10,020,603 B1 * 7/2018 Liu ..... H01R 12/7088
10,038,262 B1 * 7/2018 Behziz ..... H01R 12/79
10,044,120 B2 * 8/2018 Wang ..... H01R 12/585
10,276,984 B2 * 4/2019 Trout ..... H01R 13/6587
10,297,966 B1 * 5/2019 Hamner ..... H01R 13/6591
2002/0142634 A1 * 10/2002 Poplawski ..... H01R 13/6594 439/98
2004/0127102 A1 * 7/2004 Poplawski ..... G02B 6/4246 439/630
2004/0229509 A1 * 11/2004 Consoli ..... H01R 12/716 439/607.05
2004/0235352 A1 * 11/2004 Takemasa ..... H01R 12/52 439/607.07
2008/0220630 A1 * 9/2008 Sipe ..... H01R 13/514 439/74
2008/0242161 A1 * 10/2008 Takada ..... H01R 12/716 439/884
2010/0184307 A1 * 7/2010 Arai ..... H04M 1/76 439/65
2011/0136388 A1 * 6/2011 Fu ..... H01R 12/721 439/637
2016/0308306 A1 * 10/2016 Hung ..... H01R 13/6275
2019/0165506 A1 * 5/2019 Watanabe ..... H01R 12/737
2019/0173212 A1 * 6/2019 Tsuji ..... H01R 12/722

FOREIGN PATENT DOCUMENTS

JP 2004-523087 A 7/2004
JP 2004-288453 A 10/2004
JP 2004349126 A 12/2004
JP 2011-192612 A 9/2011

* cited by examiner

CONNECTOR

CROSS-REFERENCE TO RELATED APPLICATION

This application claims the benefit of the filing date under 35 U.S.C. § 119(a)-(d) of Japanese Patent Application No. 2017-227691, filed on Nov. 28, 2017.

FIELD OF THE INVENTION

The present invention relates to a connector and, more particularly, to a connector having a circuit board for relaying a signal.

BACKGROUND

A known signal relay connector has a daughterboard with a first edge having a plurality of first connection pads arranged thereon and a second edge having a plurality of second connection pads arranged thereon. The daughterboard has printed wiring for connecting a first connection pad with a second connection pad. Thus, in the signal relay connector, a signal sent and/or received between a first circuit connected to the first edge and a second circuit connected to the second edge is relayed.

Japanese Patent Application No. 2004-523087A discloses an electrical connector assembly serving as such a signal relay connector. The electrical connector assembly has a circuit board equivalent to the daughterboard, a plurality of first connection pads arranged at a lower end edge of the circuit board, and a plurality of second connection pads arranged at a side end edge extending vertically on the circuit board. The electrical connector assembly also has contacts contacting the first connection pads. The periphery of the circuit board is substantially completely enclosed with a housing to constitute the electrical connector assembly. The electrical connector assembly, in its integrally assembled state, has the contacts connected to a motherboard by press-fitting.

Signals relayed by connectors have increasing speed in modern applications. As the speed of the signal increases, the daughterboard inside the connector also frequently generates heat. Lowering the temperature of the connector is a critical issue in maintaining proper functioning of the connector. In the electrical connector assembly of JP 2004-523087A, the periphery of the daughterboard is substantially completely covered with the housing; the electrical connector assembly has a structure allowing very little air to be exchanged between inside and outside. For this reason, in the electrical connector assembly of JP 2004-523087A, the heat generated at the daughterboard accumulates inside the housing, which causes the temperature of the electrical connector assembly to increase.

SUMMARY

A connector comprises a daughterboard and a metallic shell. The daughterboard has a first edge with first connection pads and a second edge with second connection pads. The first edge is inserted into an on-board connector including first contacts. The on-board connector is mounted on a motherboard and each of the first connection pads is connected to one of the first contacts. The metallic shell has side plates each facing and extending along one of a front board face and a back board face of the daughterboard. Each of the side plates has a base spaced apart from the front board face or the back board face and a retaining portion protruding inward from the base. The retaining portion retains the front board face or a back board face of the daughterboard and has an opening formed around the retaining portion extending through the metallic shell.

BRIEF DESCRIPTION OF THE DRAWINGS

The invention will now be described by way of example with reference to the accompanying Figures, of which.

DETAILED DESCRIPTION OF THE EMBODIMENT(S)

Figure 1A:
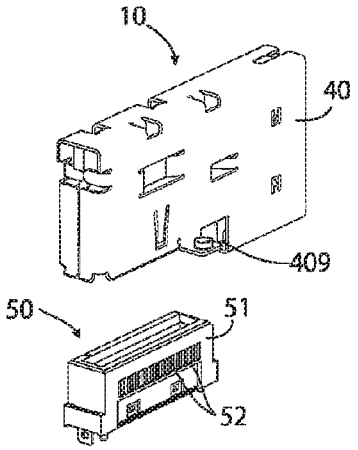
FIG. 1A is a rear perspective view of a signal relay connector and an on-board connector prior to mating.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

Figure 1B:
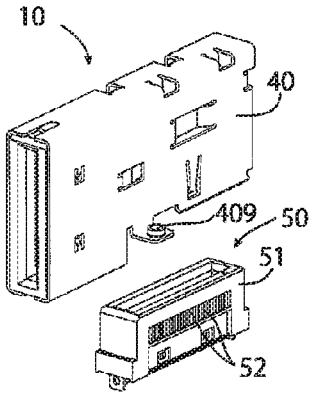
FIG. 1B is a front perspective view of the signal relay connector and the on-board connector prior to mating.

A signal relay connector 10 and an on-board connector 50 are shown in FIGS. 1A and 1B. The signal relay connector 10 and the on-board connector 50 are matable with each other and are shown before mating in FIGS. 1A and 1B. The on-board connector 50 is mounted on a motherboard 60, shown in FIGS. 3A and 3B. The on-board connector 50, as shown in FIGS. 1A and 1B, includes a housing 51 and a plurality of first contacts 52. After the signal relay connector 10 is mated with the on-board connector 50, a fastener, such as a screw, is inserted into a screw hole 409 of the signal relay connector 10, and the signal relay connector 10 is secured to the motherboard 60. The signal relay connector 10 may also be referred to as a connector herein.

Figure 2A:
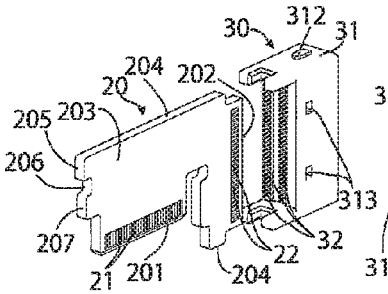
FIG. 2A is a rear perspective view of a first step of an assembly process of the signal relay connector.
Figure 2B:
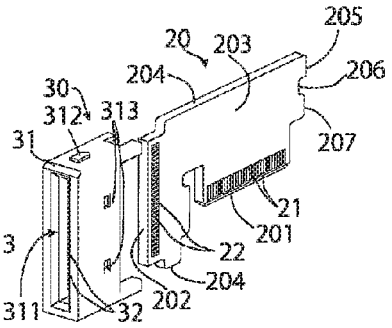
FIG. 2B is a front perspective view of the first step of the assembly process of the signal relay connector.
Figure 2C:
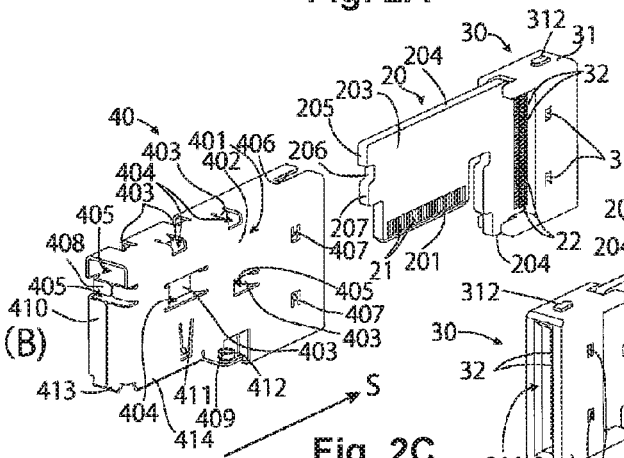
FIG. 2C is a rear perspective view of a second step of the assembly process of the signal relay connector.
Figure 2D:
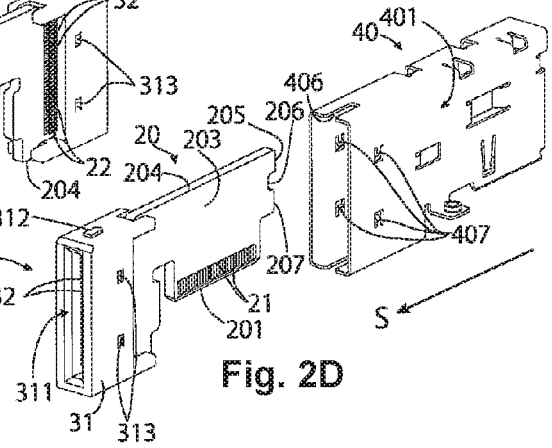
FIG. 2D is a front perspective view of the second step of the assembly process of the signal relay connector.
Figure 2E:
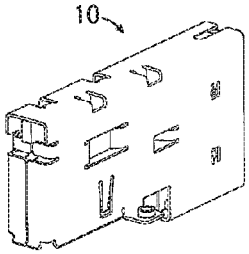
FIG. 2E is a rear perspective view of the signal relay connector in an assembled state.
Figure 2F:
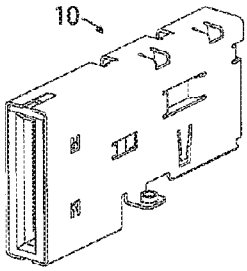
FIG. 2F is a front perspective view of the signal relay connector in the assembled state.

An assembling process of the signal relay connector 10 is shown in FIGS. 2A-2F. The signal relay connector 10 comprises a daughterboard 20, a built-in connector 30, and a metallic shell 40. FIGS. 2A and 2B show the daughterboard 20 and the built-in connector 30 before mating. FIGS. 2C and 2D show the daughterboard 20 and the built-in connector 30 in their mated state with the metallic shell 40. FIGS. 2E and 2F show the signal relay connector 10 after assembly. Each pair of Figures, such as 2A and 2B, 2C and 2D, and 2E and 2F are from different directions in a same state of mating.

The daughterboard 20, as shown in FIGS. 2A-2D, has a lower end edge 201 having a plurality of first connection pads 21 arranged thereon and a side end edge 202 having a plurality of second connection pads 22 arranged thereon. Each of the plurality of first connection pads 21 and corresponding one of the plurality of second connection pads 22 are paired and electrically connected together via printed wiring on the daughterboard 20. The lower end edge 201 and the side end edge 202 of the daughterboard 20 may also be referred to as a first edge and a second edge, respectively.

When the signal relay connector 10 is mated with the on-board connector 50 shown in FIGS. 1A and 1B, the lower end edge 201 of the daughterboard 20 is inserted into the on-board connector 50. Each of the plurality of first connection pads 21 arranged on the lower end edge 201 is connected to one of a plurality of first contacts 52 of the on-board connector 50.

The built-in connector 30, as shown in FIGS. 2A-2D, includes a housing 31 and a plurality of second contacts 32 arranged in the housing 31. The side end edge 202 of the daughterboard 20 is inserted into the built-in connector 30. Thereafter, each of the plurality of second connection pads 22 arranged on the side end edge 202 is soldered to each of the plurality of second contacts 32 of the built-in connector 30.

As shown in FIGS. 2B and 2D, a mating opening 311 opened outward is formed in the built-in connector 30. One end edge of an external board is inserted into the mating opening 311. A plurality of third connection pads similar to, for example, the plurality of second connection pads 22 arranged on the side end edge 202 of the daughterboard 20 are arranged on the end edge of the external board inserted into the built-in connector 30. Each of the plurality of second connection pads 22 arranged on the side end edge 202 of the daughterboard 20 and each of the plurality of third connection pads arranged on the inserted end edge of the external board are connected together by the second contacts 32.

After the daughterboard 20 is inserted into the built-in connector 30, as shown in FIGS. 2C and 2D, the daughterboard 20 and the built-in connector 30 are covered with the metallic shell 40. The metallic shell 40 has a pair of side plates 401 facing and extending along front and back board faces 203, respectively, of the daughterboard 20. Each of the pair of side plates 401 has a base 402 and a retaining portion 403. The base 402 extends separately from the board face 203 of the daughterboard 20 and in parallel with the board face 203. The retaining portion 403 has a shape protruding inward from the base 402. The retaining portion 403 retains the front and back board faces 203 of the daughterboard 20. The daughterboard 20 is retained by the retaining portions 403 of the pair of side plates 401 from both the front and back faces, and is supported in a position separated from both the bases 402 of the side plates 401 at both sides. With the formation of the retaining portion 403, an opening 404 opened through the metallic shell 40 is formed around the retaining portion 403. Moreover, an opening 405 is also formed in a region other than the periphery of the retaining portion 403 for retaining the board face 203 of the daughterboard 20.

The daughterboard 20 generates heat during operation. As a signal relayed by the daughterboard 20 speeds up, the amount of heat generated also increases.

In the signal relay connector 10, the bases 402 of the side plates 401 of the metallic shell 40 are positioned spaced apart from the front and back board faces 203 of the daughterboard 20; the retaining portion 403 of the side plates 401 retains the board face 203 of the daughterboard 20. Moreover, the opening 404 around the retaining portion 403 and another opening 405 are formed in the metallic shell 40. Due to this structure, air heated by the heat generation of the daughterboard 20 flows out through these openings 404, 405. Heat thereby does not accumulate inside, and an internal temperature rise due to the heat generation of the daughterboard 20 can be suppressed.

In addition, in the signal relay connector 10, the metallic shell 40 covers the daughterboard 20, as shown in FIGS. 2C-2F. The metallic shell 40 has high thermal conductivity as compared with, for example, resin or the like. Therefore, the heat generated by the daughterboard 20 is rapidly dissipated by thermal conduction through the metallic shell 40 having high thermal conductivity.

As shown in FIGS. 2A-2C, protrusions 312 are provided on upper and lower faces of a housing 31 of the built-in connector 30. In the drawings, however, the lower face of the housing 31 is obscured, and only the protrusion 312 of the upper face is depicted. In correspondence with these protrusions 312, notches 406 are formed at ends near the built-in connector 30 of upper and lower faces of the metallic shell 40. When the daughterboard 20 and the built-in connector 30 are covered with the metallic shell 40, the metallic shell 40 is slid and fitted in the direction of an arrow S shown in FIGS. 2C and 2D. The protrusion 312 of the built-in connector 30 is press-fitted into the notch 406 of the metallic shell 40. A recess 313 is formed in a side face of the housing 31 of the built-in connector 30. A lanced portion 407 for entering the recess 313 is formed in the metallic shell 40. When the protrusion 312 of the built-in connector 30 is press-fitted into the notch 406 of the metallic shell 40, the lanced portion 407 simultaneously enters the recess 312 of the built-in connector 30. The metallic shell 40 is thus secured to the built-in connector 30.

Upper and lower end faces 204 of the daughterboard 20 come into contact with upper and lower faces of the metallic shell 40, and thereby the vertical position of the daughterboard 20 is restricted. A recess 206 and a protrusion 207 immediately below the recess 206 are formed in a side end face 205 of the daughterboard 20, as shown in FIGS. 2A-2D, opposite to a side inserted into the built-in connector 30. An abutting portion 408 of the metallic shell 40 enters the recess 206 and abuts against the recess 206. In addition, simultaneously, the protrusion 207 immediately below the recess 206 abuts against a vertical wall 410 of the metallic shell 40. The position of the daughterboard 20 is thereby restricted in the direction of the arrow S shown in FIGS. 2C and 2D.

As shown in FIG. 2C, locking tabs 411 lanced inward are formed in the right and left side plates 401 of the metallic shell 40. These locking tabs 411 serve as a lock to the on-board connector 50 shown in FIGS. 1A and 1B.

Figure 3A:
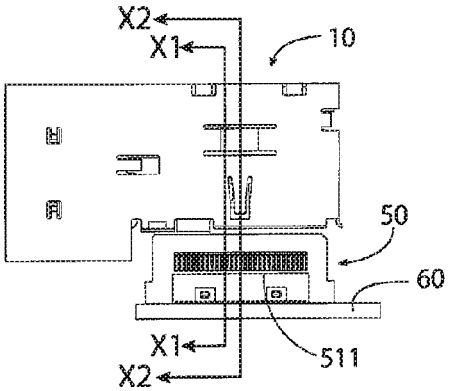
FIG. 3A is a side view of the signal relay connector mated with the on-board connector.
Figure 3B:
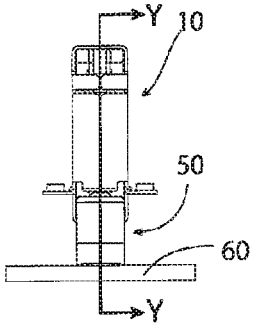
FIG. 3B is a rear view of the signal relay connector mated with the on-board connector.

A fastening portion 412 of the metallic shell 40 extends outward along a surface of the motherboard 60 from a lower end edge of each of the pair of side plates 401, namely, an end edge of the metallic shell 40 near the motherboard 60 as shown in FIGS. 3A and 3B. The screw hole 409 is formed in the fastening portion 412. As described above, a screw is inserted into the screw hole 409 to fasten the signal relay connector 10 to the motherboard 60.

Guiding portions 413, 414 are provided in the metallic shell 40 as shown in FIG. 2C. These guiding portions 413, 414 are for guiding the signal relay connector 10 when the signal relay connector 10 is mated with the on-board connector 50. The locking tab 411, the fastening portion 412, and the guiding portion 413, 414 will be described in greater detail below.

The signal relay connector 10, the on-board connector 50, and the motherboard 60 mounted with the on-board connector 50 are shown in FIGS. 3A and 3B. Though the motherboard 60 is a board having a wider area, only a portion mounted with the on-board connector 50 is shown in FIGS. 3A and 3B.

Figure 4A:
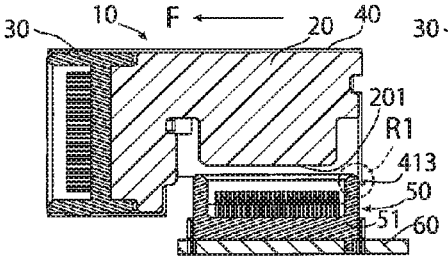
FIG. 4A is a sectional view of an initial stage of a process of mating the signal relay connector with the on-board connector misaligned in a first direction, taken along line Y-Y of FIG. 3B.
Figure 4B:
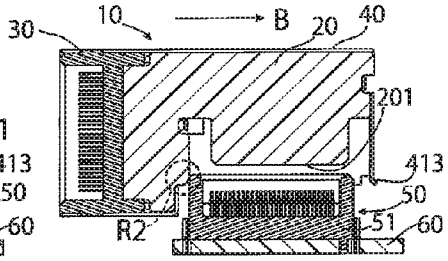
FIG. 4B is a sectional view of an initial stage of the process of mating the signal relay connector with the on-board connector misaligned in a second direction, taken along line Y-Y of FIG. 3B.
Figure 4C:
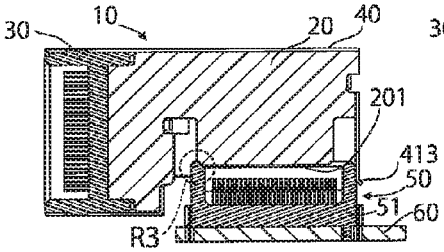
FIG. 4C is a sectional view of an intermediate stage of the process of mating the signal relay connector with the on-board connector misaligned in the first direction, taken along line Y-Y of FIG. 3B.
Figure 4D:
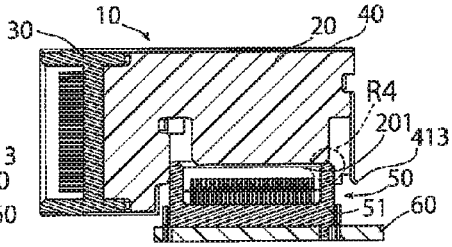
FIG. 4D is a sectional view of an intermediate stage of the process of mating the signal relay connector with the on-board connector misaligned in the second direction, taken along line Y-Y of FIG. 3B.
Figure 4E:
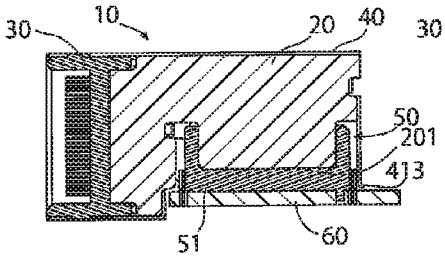
FIG. 4E is a sectional view of a final stage of the process of mating the signal relay connector with the on-board connector misaligned in the first direction, taken along line Y-Y of FIG. 3B.
Figure 4F:
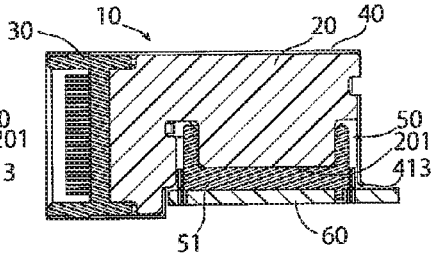
FIG. 4F is a sectional view of a final stage of the process of mating the signal relay connector with the on-board connector misaligned in the second direction, taken along line Y-Y of FIG. 3B.

A process of mating the signal relay connector 10 with the on-board connector 50 is shown in FIGS. 4A-4F. FIGS. 4A and 4B show an initial stage of mating. FIGS. 4C and 4D show a stage at which mating has progressed from the initial stage shown in FIGS. 4A and 4B. FIGS. 4E and 4F show a final stage of mating. Each pair of Figures, such as 4A and 4B, 4C and 4D, and 4E and 4F depict different alignments in the directions F and B of the signal relay connector 10 and the on-board connector 50 in a same state of mating.

Figure 5A:
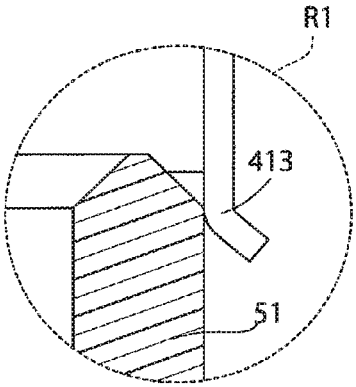
FIG. 5A is an enlarged view of a portion R1 of FIG. 4A.

The metallic shell 40 of the signal relay connector 10, as shown in FIGS. 4A-4F, has the guiding portion 413. If mating is started with the signal relay connector 10 misaligned slightly in the direction of the arrow F, as shown in FIG. 4A and FIG. 5A, the guiding portion 413 of the metallic shell 40 is guided by an outer wall face of the housing 51 of the on-board connector 50, and thereby the misalignment of the signal relay connector 10 in the direction of the arrow F is slightly corrected. During the process of mating, as shown in FIG. 4C and FIG. 5C, an end face of the daughterboard 20 is next guided by an inner wall face of the housing 51 of the on-board connector 50, and thereby the misalignment in the direction of the arrow F is further corrected. Eventually, as shown in FIG. 4E, the signal relay connector 10 is guided to a correct position with respect to the directions of the arrows F-B, and thereby the lower end edge 201 of the daughterboard 20 is correctly inserted into the on-board connector 50.

Figure 5B:
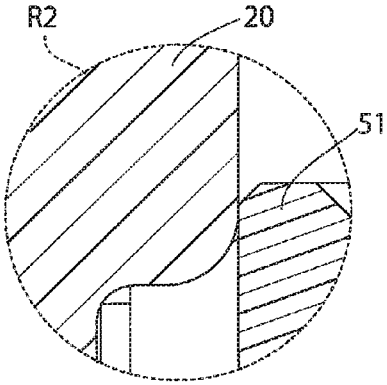
FIG. 5B is an enlarged view of a portion R2 of FIG. 4B.
Figure 5C:
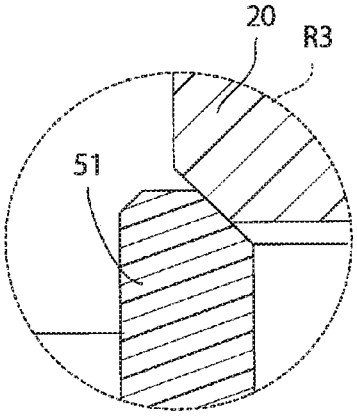
FIG. 5C is an enlarged view of a portion R3 of FIG. 4C.
Figure 5D:
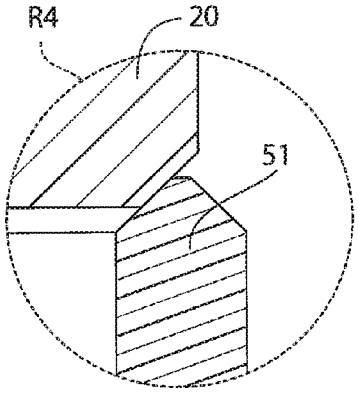
FIG. 5D is an enlarged view of a portion R4 of FIG. 4D.

If mating is started with the signal relay connector 10 misaligned slightly in the direction of the arrow B, as shown in FIGS. 4B and 5B, an end edge of the daughterboard 20 is guided by an outer wall face of the housing 51 of the on-board connector 50, and the misalignment of the signal relay connector 10 in the direction of the arrow B is slightly corrected. During the process of mating, as shown in FIG. 4D and FIG. 5D, an end face of the daughterboard 20 is next guided by an inner wall face of the housing 51 of the on-board connector 50, and thereby the misalignment in the direction of the arrow B is further corrected. Eventually, as shown in FIG. 4F, the signal relay connector 10 is guided to a correct position with respect to the directions of the arrows F-B, and thereby the lower end edge 201 of the daughterboard 20 is correctly inserted into the on-board connector 50.

Because the metallic shell 40 has the guiding portion 413, the metallic shell 40 also has a guiding function for mating. This widens the tolerance for misalignment of the signal relay connector 10 at the start of mating in the directions of the arrows F-B with respect to the on-board connector 50.

Figures 6A, 6B:
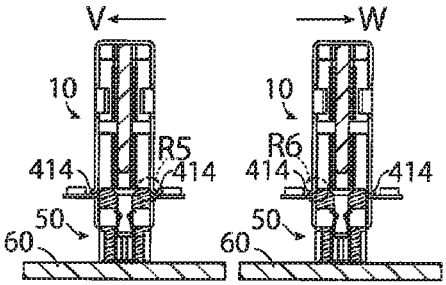
FIG. 6A is a sectional view of an initial stage of a process of mating the signal relay connector with the on-board connector misaligned in a third direction, taken along line X1-X1 of FIG. 3A.
FIG. 6B is a sectional view of an initial stage of a process of mating the signal relay connector with the on-board connector misaligned in a fourth direction, taken along line X1-X1 of FIG. 3A.
Figures 6C, 6D:
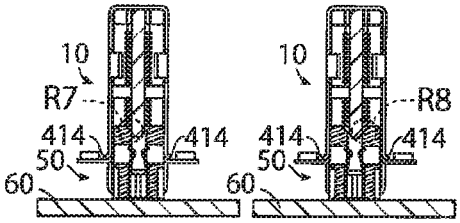
FIG. 6C is a sectional view of an intermediate stage of the process of mating the signal relay connector with the on-board connector misaligned in the third direction, taken along line X1-X1 of FIG. 3A.
FIG. 6D is a sectional view of an intermediate stage of the process of mating the signal relay connector with the on-board connector misaligned in the fourth direction, taken along line X1-X1 of FIG. 3A.
Figures 6E, 6F:
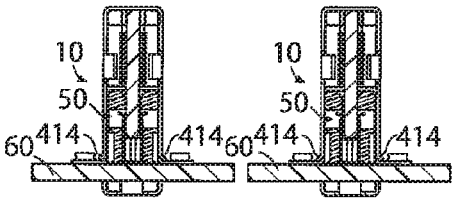
FIG. 6E is a sectional view of a final stage of the process of mating the signal relay connector with the on-board connector misaligned in the third direction, taken along line X1-X1 of FIG. 3A.
FIG. 6F is a sectional view of a final stage of the process of mating the signal relay connector with the on-board connector misaligned in the fourth direction, taken along line X1-X1 of FIG. 3A.

The process of mating the signal relay connector 10 with the on-board connector 50 is also shown in FIGS. 6A-6F in a different view. FIGS. 6A and 6B show an initial stage of mating. FIGS. 6C and 6D show a stage at which mating has progressed from the initial stage shown in FIGS. 6A and 6B. FIGS. 6E and 6F show a final stage of mating. Each pair of Figures, such as 6A and 6B, 6C and 6D, and 6E and 6F depict different alignments in the directions V and W of the signal relay connector 10 and the on-board connector 50 in a same state of mating.

The metallic shell 40 of the signal relay connector 10 has the guiding portion 414, as shown in FIGS. 6A-6F. The guiding portion 414 is angled at 90 degrees from the guiding portion 413 shown in FIGS. 4A-4F.

Figure 7A:
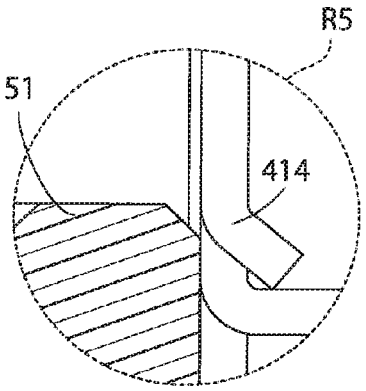
FIG. 7A is an enlarged view of a portion R5 of FIG. 7A.

If mating is started with the signal relay connector 10 misaligned slightly in the direction of the arrow V, as shown in FIGS. 6A and 7A, the guiding portion 414 of the metallic shell 40 is guided by an outer wall face of the housing 51 of the on-board connector 50, and thereby the misalignment of the signal relay connector 10 in the direction of the arrow V is slightly corrected. As mating progresses, as shown in FIG. 6C and FIG. 7C, the board face of the daughterboard 20 is next guided by an inner wall face of the housing 51 of the on-board connector 50, and thereby the misalignment in the direction of the arrow V is further corrected. Eventually, as shown in FIG. 6E, the signal relay connector 10 is guided to a correct position with respect to the directions of the arrows V-W, and the lower end edge 201 of the daughterboard 20 is correctly inserted into the on-board connector 50.

Figure 7B:
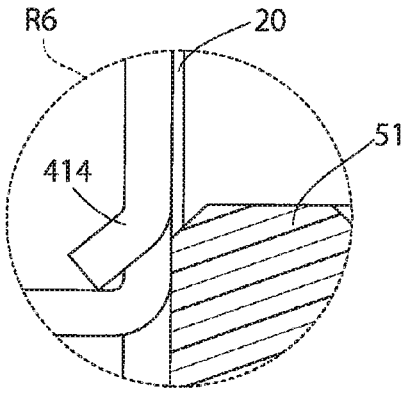
FIG. 7B is an enlarged view of a portion R6 of FIG. 7B.
Figure 7C:
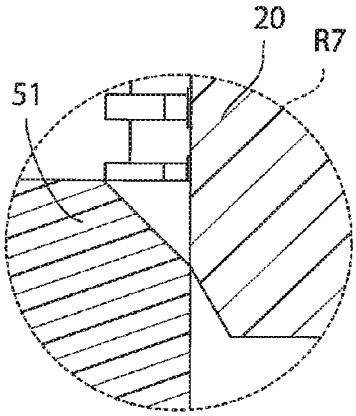
FIG. 7C is an enlarged view of a portion R7 of FIG. 7C.
Figure 7D:
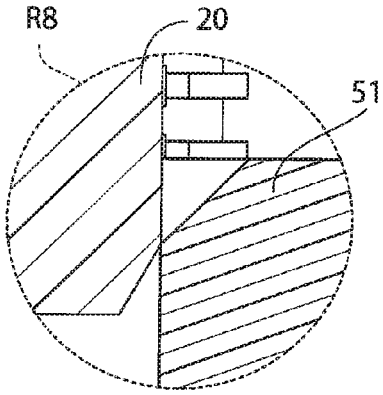
FIG. 7D is an enlarged view of a portion R8 of FIG. 7D.

If mating is started with the signal relay connector 10 misaligned slightly in the direction of the arrow W, as shown in FIG. 6B and FIG. 7B, the guiding portion 414 of the metallic shell 40 is guided by an outer wall face of the housing 51 of the on-board connector 50, and thereby the misalignment of the signal relay connector 10 in the direction of the arrow W is slightly corrected. As mating progresses, as shown in FIG. 6D and FIG. 7D, the board face of the daughterboard 20 is next guided by an inner wall face of the housing 51 of the on-board connector 50, and thereby the misalignment in the direction of the arrow W is further corrected. Eventually, as shown in FIG. 6F, the signal relay connector 10 is guided to a correct position with respect to the directions of the arrows V-W, and thereby the lower end edge 201 of the daughterboard 20 is correctly inserted into the on-board connector 50.

Because the metallic shell 40 has the guiding portion 414, the metallic shell 40 also has a guiding function for mating. This widens the tolerance for misalignment of the signal relay connector 10 at the start of mating in the directions of the arrows V-W with respect to the on-board connector 50.

Figure 8A:
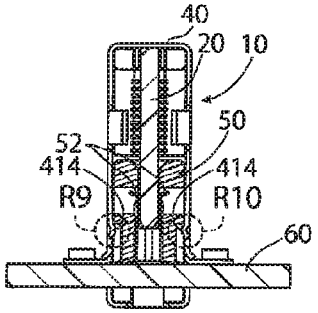
FIG. 8A is a sectional view of the signal relay connector and the on-board connector in a completely mated state, taken along line X2-X2 in FIG. 3A.
Figure 8B:
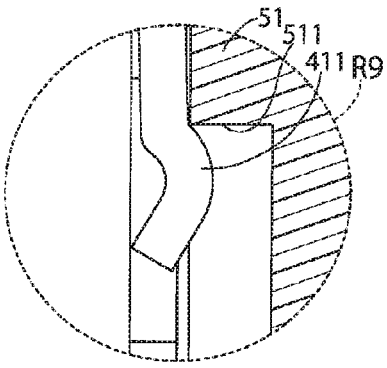
FIG. 8B is an enlarged view of a portion R9 of FIG. 8A.
Figure 8C:
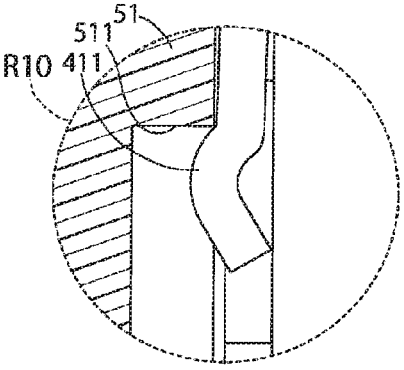
FIG. 8C is an enlarged view of a portion R10 of FIG. 8A.

The signal relay connector 10 and the on-board connector 50 are shown in the fully mated state in FIGS. 8A-8C. The locking tabs 411 are formed in both of the side plates 401 of the metallic shell 40 of the signal relay connector 10. When the signal relay connector 10 is mated with the on-board connector 50, the right and left locking tabs 411 are caught in stepped portions 511 provided in outer wall faces of the housing 51 of the on-board connector 50. Thereby, the signal relay connector 10 is intended to be temporarily prevented from unintentionally slipping out of the on-board connector 50. Thereafter, as described above, the signal relay connector 10 is screwed to the motherboard 60.

Figure 9:
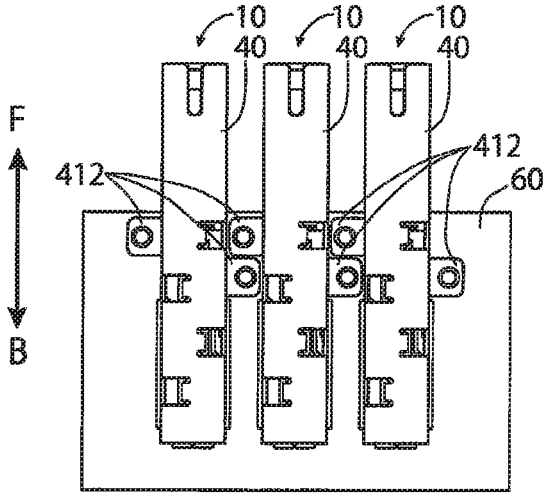
FIG. 9 is a top view of a plurality of signal relay connectors and a plurality of on-board connectors arranged on a motherboard.

A plurality of signal relay connectors 10 and a plurality of on-board connectors 50 arranged on the motherboard 60 are shown in FIG. 9. In the metallic shell 40 of the signal relay connector 10, as shown in FIGS. 2C-2F, the fastening portion 412 extends from each of the pair of side plates 401. In each of the signal relay connectors 10, the two fastening portions 412 extending rightward and leftward from the pair of side plates 401 are disposed, as shown in FIG. 9, in positions not overlapping with each other with respect to an extending direction of the lower end edge 201 of the daughterboard 40, namely, the directions of the arrows F-B in FIG. 9. Because the fastening portions 412 are provided in positions not overlapping with each other with respect to the directions of the arrows F-B, the plurality of signal relay connectors 10 can be positioned densely, as compared with a case where the two fastening portions 412 are provided in positions overlapping with each other with respect to the directions of the arrows F-B.

The signal relay connector 10 is described herein with the built-in connector 30. In other embodiments, the connector 10 may be a connector of a type not provided with a built-in connector, and the side end edge 202 of the daughterboard 20 is also inserted into an external connector having contacts arranged thereon for making connections to the second connection pads 22 arranged on the side end edge 202, in the same manner as the lower end edge 201.

What is claimed is:

1. A connector, comprising:

a daughterboard having a first edge with a plurality of first connection pads arranged thereon and a second edge with a plurality of second connection pads arranged thereon, the first edge being inserted into an on-board connector including a plurality of first contacts, the on-board connector is mounted on a motherboard and each of the plurality of first connection pads is connected to one of the plurality of first contacts; and a metallic shell having a pair of side plates each facing and extending along one of a front board face and a back board face of the daughterboard, each of the pair of side plates has a base spaced apart from the front board face or the back board face of the daughterboard and a retaining portion protruding inward from the base, the retaining portion is adapted to retain the front board face or the back board face of the daughterboard and has an opening formed around the retaining portion extending through the metallic shell.

2. The connector of claim 1, wherein the metallic shell has a guiding portion contacting the on-board connector and guiding the first edge when the first edge is inserted into the on-board connector.

3. The connector of claim 1, wherein the metallic shell has a locking tab caught in the on-board connector and locking the connector in a state in which the first edge is inserted in the on-board connector.

4. The connector of claim 1, wherein the metallic shell has a fastening portion extending outward from each of the pair of side plates and extending along a surface of the motherboard.

5. The connector of claim 4, wherein the fastening portion is adapted to receive a fastener to fasten the metallic shell to the motherboard.

6. The connector of claim 4, wherein the fastening portions of the pair of side plates do not overlap with each other in an extending direction of the first edge.

7. The connector of claim 1, further comprising a built-in connector into which the second edge is inserted.

8. The connector of claim 7, wherein the built-in connector is adapted to receive a third edge of an external connector, the third edge having a plurality of third connection pads arranged thereon.

9. The connector of claim 8, wherein the built-in connector has a plurality of second contacts connecting the second connection pads with the third connection pads.

* * * * *